US008251180B1

(12) United States Patent
Paige

(10) Patent No.: US 8,251,180 B1
(45) Date of Patent: Aug. 28, 2012

(54) LADDER STABILIZER APPARATUS

(76) Inventor: Michael J. Paige, Port Tobacco, MD (US)

( * ) Notice: Subject to any disclaimer, the term of this patent is extended or adjusted under 35 U.S.C. 154(b) by 308 days.

(21) Appl. No.: 12/820,946

(22) Filed: Jun. 22, 2010

(51) Int. Cl.
*E06C 7/48* (2006.01)

(52) U.S. Cl. ..... 182/107; 182/214

(58) Field of Classification Search ..... 182/107, 182/116, 200, 214, 129
See application file for complete search history.

(56) References Cited

U.S. PATENT DOCUMENTS

| | | | | |
|---|---|---|---|---|
| 3,100,026 | A * | 8/1963 | Sunshine | 182/214 |
| 3,288,249 | A | 11/1966 | Gibson | |
| 3,713,510 | A * | 1/1973 | O'Dell | 182/20 |
| 4,394,887 | A * | 7/1983 | Spinks | 182/214 |
| 4,483,416 | A * | 11/1984 | Garcia | 182/107 |
| 5,121,814 | A | 6/1992 | Southern | |
| 5,460,240 | A * | 10/1995 | Jones | 182/116 |
| 5,551,528 | A * | 9/1996 | Vieito | 182/129 |
| D406,652 | S | 3/1999 | Marchand | |
| 5,899,296 | A * | 5/1999 | Lantz | 182/214 |
| 6,244,382 | B1 * | 6/2001 | Labonte | 182/107 |
| 6,578,665 | B1 | 6/2003 | DeBaca et al. | |
| 6,691,825 | B2 * | 2/2004 | Haig | 182/107 |
| 6,698,547 | B1 * | 3/2004 | Uridel | 182/107 |
| 6,962,237 | B2 | 11/2005 | Underhill | |

FOREIGN PATENT DOCUMENTS

| | | | | |
|---|---|---|---|---|
| GB | 2144168 | A * | 2/1985 | 182/107 |

* cited by examiner

*Primary Examiner* — Katherine W Mitchell
*Assistant Examiner* — Kristine Florio

(57) ABSTRACT

The ladder stabilizer apparatus provides for removable attachment to two rungs of a ladder. The case provides pivoting sleeves that may be indirectly or directly controlled by the apparatus crank, whereby either the sleeves or the sleeves with arms with optional vertical rollers are moved toward and away from the ladder. Rollers are provided for a given surface contact with the apparatus. Movement of the sleeves and the sleeves with arms provides for the contact devices to be positioned partially around a structure or object corner, within a corner, or any position between. The contact devices may be positioned outside boundaries of a window, for example, to provide a user best access to a window or other area that is not designed to have a ladder rested against it. The apparatus may be adjusted while in use.

18 Claims, 5 Drawing Sheets

LADDER STABILIZER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

BACKGROUND OF THE INVENTION

The problems associated with stabilizing a ladder are well understood and, as such, a plethora of devices have been presented in attempt to stabilize ladders and thereby reduce safety risks in their use. Devices for attaching a ladder to a structure have obvious drawbacks, as ladders are initially designed to directly lean against a structure and not face the problems associated with attachment and detachment. Of the various devices designed to stabilize a ladder without requiring attachment to the ladder, safety often remains a primary issue. Of the devices proposed for stabilizing a ladder that require attachment to the ladder, full and rapid conformity to a structure against which the ladder leans has not been properly provided. For example, should a large window be encountered, a typical ladder, even affixed with a stabilizing attachment, cannot rest against the window.

Further problems might include roof edges, roof materials, corners, and a host of other objects and surfaces wherein the rungs and rails of a ladder are not afforded proper support. The present apparatus solves these and other problems.

FIELD OF THE INVENTION

The ladder stabilizer apparatus relates to ladders and more especially to an apparatus that securely, adjustably, and removably attaches to a ladder and provides for the ladder with apparatus to lean safely against varied structures and surfaces, without attachment.

SUMMARY OF THE INVENTION

The general purpose of the ladder stabilizer apparatus, described subsequently in greater detail, is to provide a ladder stabilizer apparatus which has many novel features that result in an improved ladder stabilizer apparatus which is not anticipated, rendered obvious, suggested, or even implied by prior art, either alone or in combination thereof.

To attain this, the ladder stabilizer apparatus provides for removable attachment to the rungs of a ladder. Various clamps and attachments may be used to removably secure the apparatus to separate rungs of the ladder.

Additionally, while the a-frame may be extended downwardly from the v-shaped case, to connect to a next lower ladder rung, other less complex devices may make the lower rung connection. A single rod or rod-like member may be used, as may several types of downwardly oriented projections. Preferably, the semicircular clamps of both the case rung curl and the a-frame provide for quick attachment and detachment to spaced apart rungs of a ladder. The sleeves may be indirectly controlled by the apparatus crank, whereby either the sleeves or the sleeves with arms with optional vertical rollers within the arms are moved toward and away from the ladder. Various contact devices other than rollers may be used for a given surface contact with the apparatus. Movement of the sleeves and the sleeves with arms provides for the contact devices to be positioned partially around a structure or object corner, within a corner, or any position between. The contact devices may be positioned outside boundaries of a window, for example, to provide a user best access to a window or other area that is not designed to have a ladder rested against it.

The case may be provided in a v-shape to further enable sleeve movement and to decrease apparatus weight. Various means may be employed to adjust the pivoting sleeves, including direct adjustment with securing pins, direct geared adjustment, direct cable adjustment, and devices mounted to the case. A crank or other appropriate device may be employed on the exterior of the case. The most complete embodiment provides the remotely located gearbox with flexible cable for pushrod adjustment that moves the sleeves. In the ideal embodiment, both the housing and the gearbox are sealed against invasion by foreign matter and moisture.

Of differentiating importance to the apparatus is that contact with a given surface or structure can be easily adjusted while the ladder is in use. The ladder may thereby be positioned as chosen with the user still on the ladder.

Thus has been broadly outlined the more important features of the improved ladder stabilizer apparatus so that the detailed description thereof that follows may be better understood and in order that the present contribution to the art may be better appreciated.

An object of the ladder stabilizer apparatus is to stabilize a ladder against various structures.

Another object of the ladder stabilizer apparatus is to stabilize a ladder against various structures without structure attachment.

Still another object of the ladder stabilizer apparatus is to provide for a ladder and apparatus to be adjustably positioned against a surface or surfaces while in use.

A further object of the ladder stabilizer apparatus is to attach to a ladder.

An added object of the ladder stabilizer apparatus is to removably attach to a ladder.

And, an object of the ladder stabilizer apparatus is to adjustably attach to a ladder.

Yet another object of the ladder stabilizer apparatus is to conform to a large variety of surfaces, surface angles, and surface shapes.

Still another object of the ladder stabilizer apparatus is to contact a structure without structure damage.

Another object of the ladder stabilizer apparatus is to provide for angular ladder adjustment.

And, another object of the ladder stabilizer apparatus is to provide for angular ladder adjustment while the ladder is in use by a person.

These together with additional objects, features and advantages of the improved ladder stabilizer apparatus will be readily apparent to those of ordinary skill in the art upon reading the following detailed description of presently preferred, but nonetheless illustrative, embodiments of the improved ladder stabilizer apparatus when taken in conjunction with the accompanying drawings.

In this respect, before explaining the current embodiments of the improved ladder stabilizer apparatus in detail, it is to be understood that the ladder stabilizer apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved ladder stabilizer apparatus. It is therefore important that the claims be regarded as including such equivalent constructions insofar as they do not depart from the spirit and scope of the ladder stabilizer apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the ladder stabilizer apparatus generally designated by the reference number 10 will be described.

Figure 1:
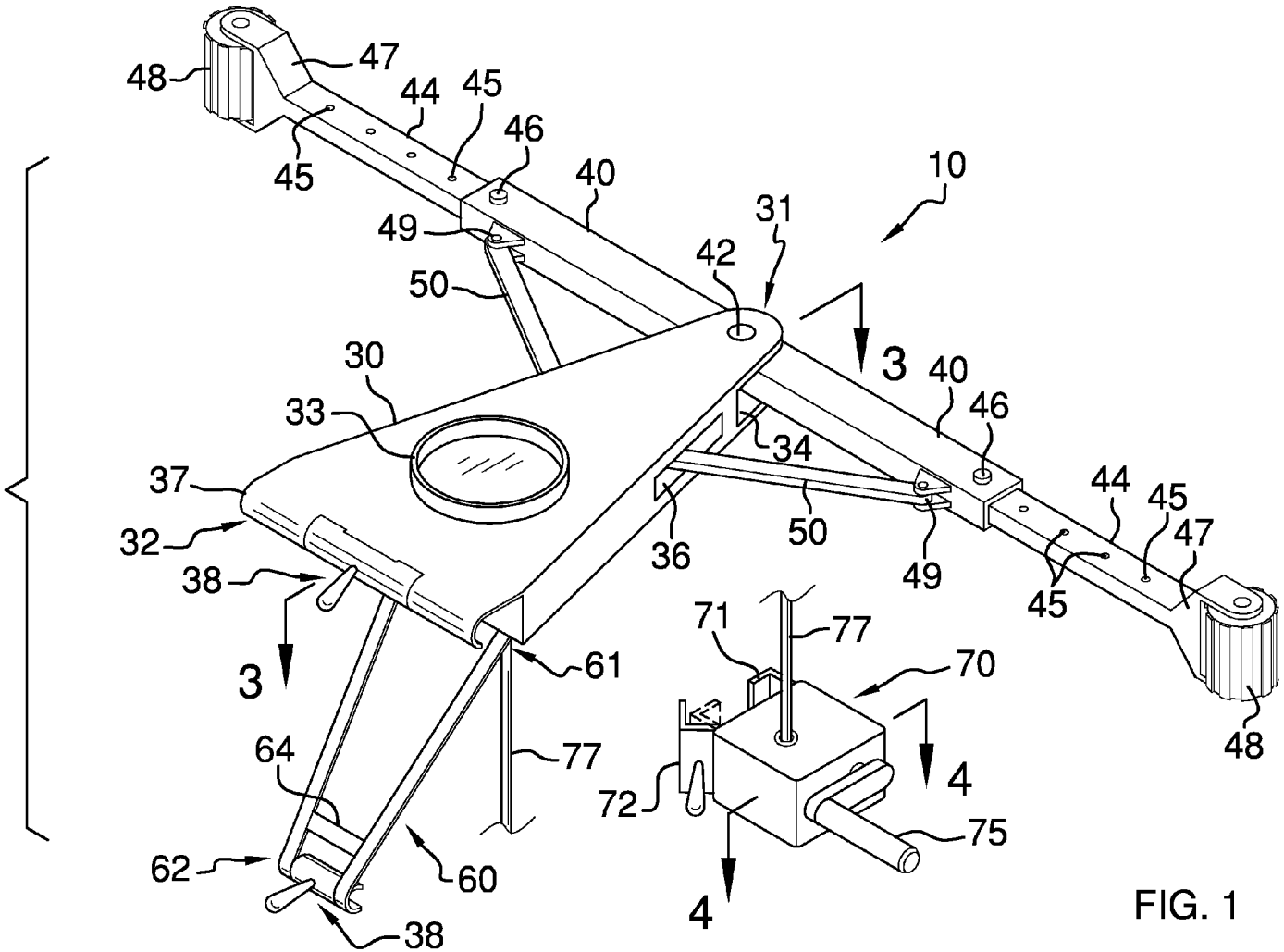
FIG. 1 is a top perspective view.

Referring to FIG. 1, the apparatus 10 partially comprises the v-shaped case 30 having a narrowed first end 31 spaced apart from the widened second end 32.

Figures 3, 4:
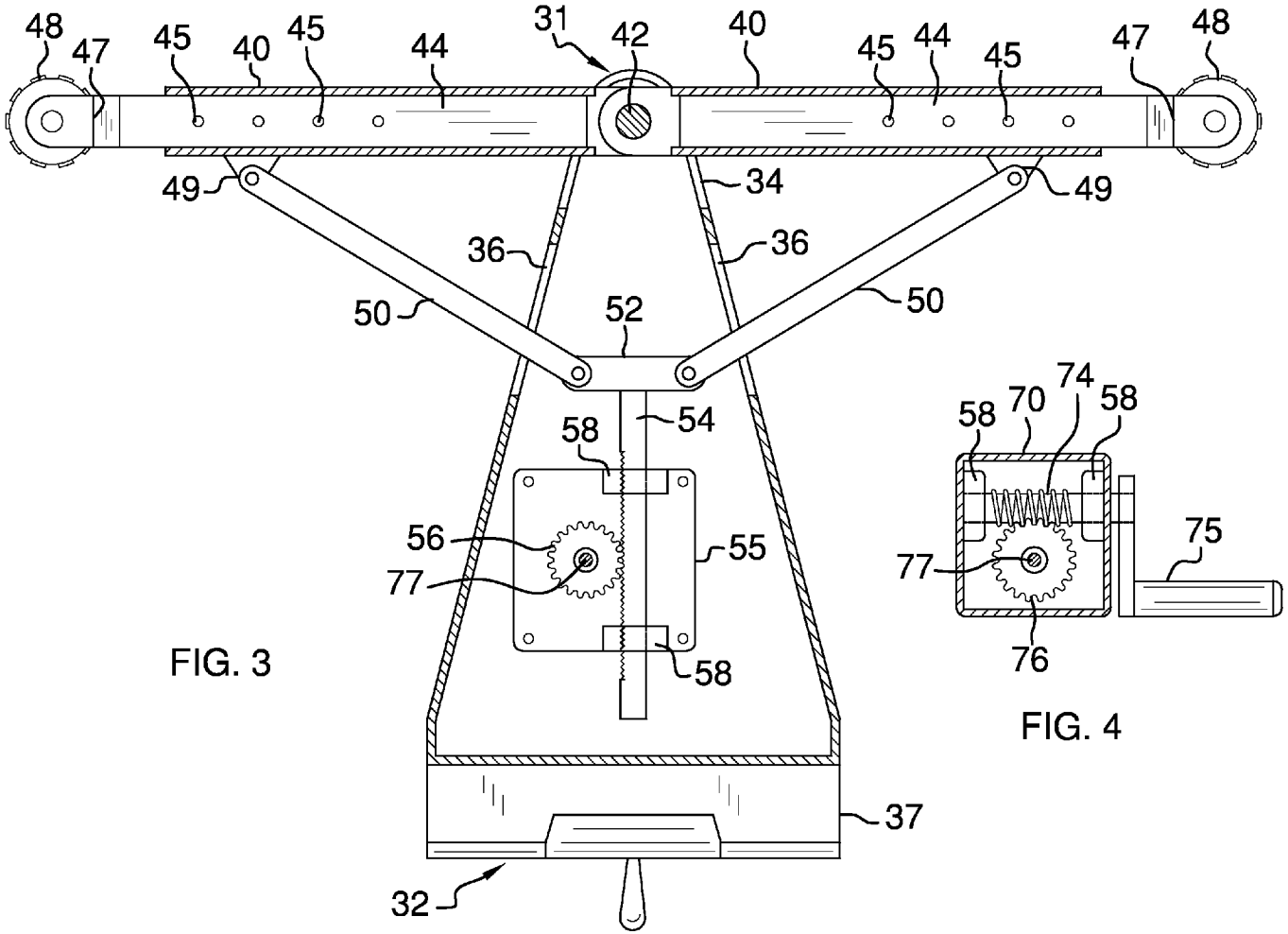
FIG. 3 is a cross sectional view of FIG. 1 taken along the line 3-3.
FIG. 4 is a cross sectional view of FIG. 1 taken along the line 4-4.

Continuing to refer to FIG. 1 and referring also to FIG. 3, the horizontal opening 34 is disposed in the first end 31. The vertical pivot 42 is disposed within the horizontal opening 34. The pair of identical sleeves 40 is pivotally affixed oppositely and horizontally to the vertical pivot 42. An identical telescopic arm 44 is slideably laterally disposed within each sleeve 40. A plurality of spaced apart orifices 45 is disposed vertically within each arm 44.

A lock pin 46 is selectively disposed through one of each of the sleeves 40 and through one of each of the orifices 45 of each telescopic arm 44, whereby the arms 44 are independently and selectively telescoped. A u-frame 47 is outwardly disposed on each telescopic arm 44. A roller 48 is disposed vertically and rotateably within each u-frame 47. The pair of identical slots 36 is disposed oppositely and laterally within the case 30. The slots 36 are proximal to the horizontal opening 34. The rod arm 52 is disposed horizontally within the case 30 between the slots 36. The pair of identical pushrods 50 is pivotally and oppositely affixed to the rod arm 52. Each pushrod 50 is extended outwardly through one of each of the slots 36. Each pushrod 50 is affixed to one of each of the sleeves 40 via a pushrod pivot 49.

Figure 5:
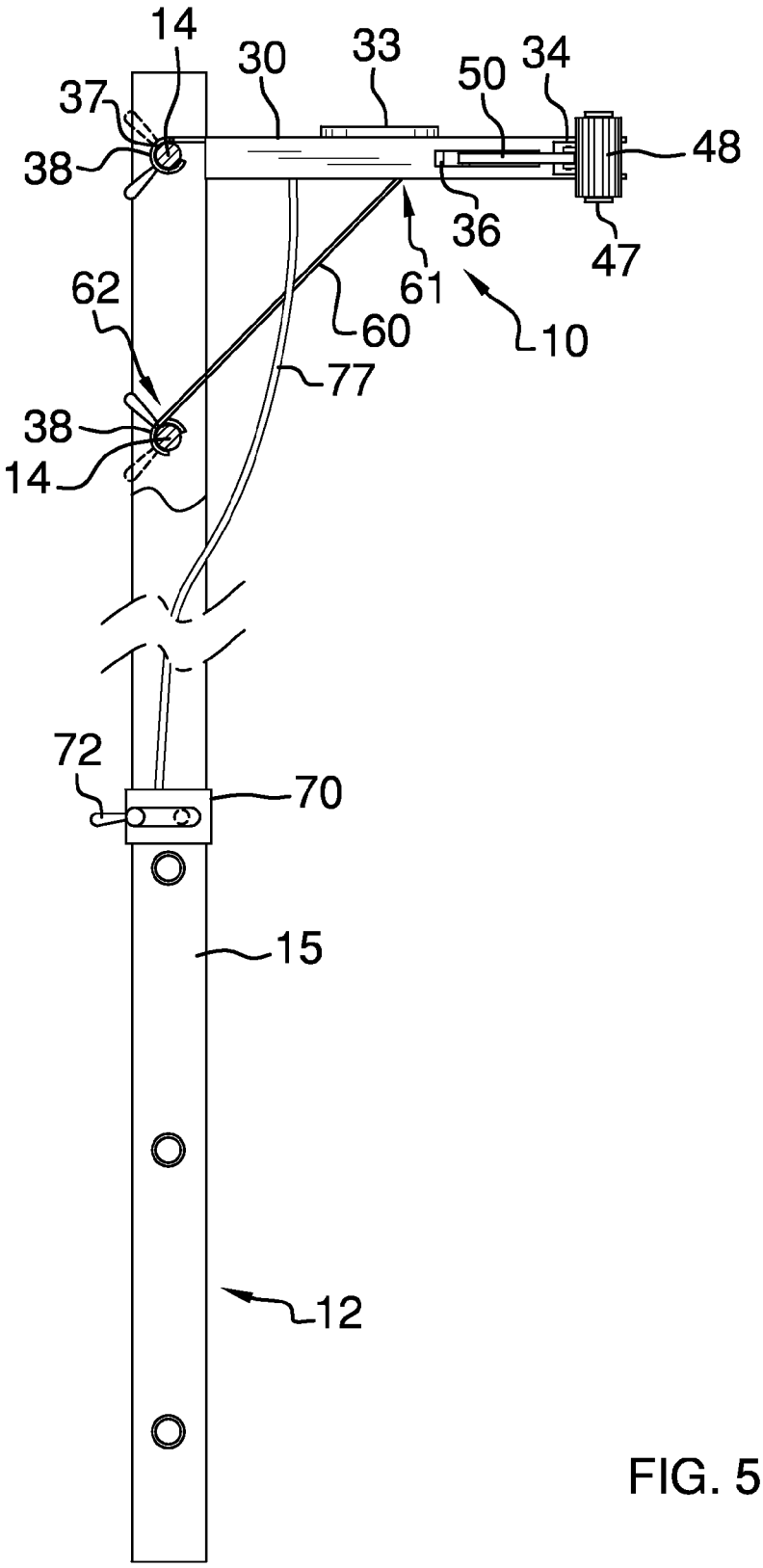
FIG. 5 is a lateral elevation view of the installed apparatus.

Referring to FIG. 5, the downwardly curled rung curl 37 is disposed on the case 30 second end 32. The rung curl 37 is removably looped over the desired rung 14 of an existing ladder 12. The semicircular lever clamp 38 is disposed centrally within the rung curl 37. The clamp 38 selectively secures the rung curl 37 to the ladder 12 rung 14. The sealed housing 55 is disposed within the case 30. The upper cable gear 56 is rotateably affixed in the horizontal plane within the housing 30. The rack 54 is disposed within the housing 30 and extended outwardly therefrom via a pair of spaced apart bushings 58. The rack 54 is in communication with the upper cable gear 56. The rack 54 is affixed perpendicularly to the rod arm 52.

Referring again to FIG. 1, the a-frame 60 has a proximal end 61 spaced apart from a distal end 62. The proximal end 61 is extended downwardly and pivotally from the v-shaped case 30. The cross brace 64 is importantly disposed within the a-frame 60 proximal to the distal end 62 for stability of the a-frame 60. The semicircular lever clamp 38 is disposed on the a-frame 60 distal end 62. The lever clamp 38 of the a-frame 60 is selectively disposed on a rung 14 of the ladder 12 below the rung curl 37. The semicircular clamp 38 of the rung curl 37 and of the a-frame 60 are selectively and removably fastened to the ladder 12 rungs 14. Referring to FIG. 4, the sealed gearbox 70 is provided. A pair of spaced apart bushings 58 is disposed within the sealed gearbox 70. The worm gear 74 is rotateably disposed within the bushings 58 and extended from the gearbox 70. The crank 75 is disposed outwardly from the gearbox 70 and affixed to the worm gear 74.

Referring to FIGS. 3, 4, and 5, the flexible cable 77 is extended from the gearbox 70 to the v-shaped case 30. The cable 77 connects the lower cable gear 76 to the upper cable gear 56.

Referring again to FIG. 1 and to FIG. 5, the rail channel 71 is spaced apart from the rail channel clamp 72. The rail channel 71 and rail channel clamp 72 are extended from the sealed gearbox 70 and provide for removably attaching the gearbox 70 to the ladder 12 rail 15. The circular holder 33 provides for holding a paint can or other chosen tool or device.

Referring to FIG. 2 and again to FIGS. 3 and 4, turning the crank 75 moves the rack 54 in the plane of the case 30 first end 31 and second end 32. This action pivots the pushrods 50 relative to the v-shaped case 30. The rollers 48 are thereby able to contact a given surface as needed.

Figure 6:
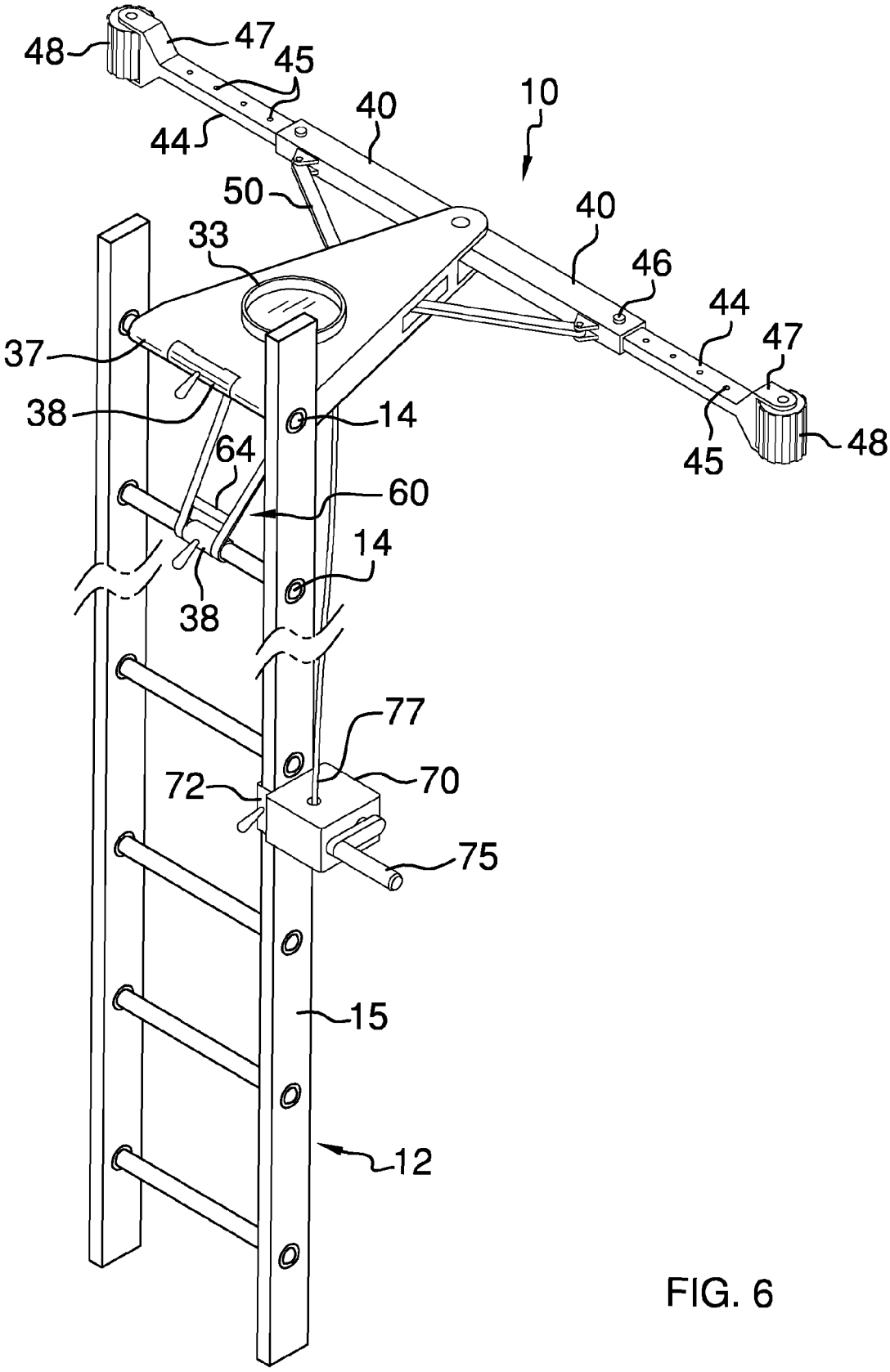
FIG. 6 is a perspective view of the installed apparatus.

Referring to FIG. 6, the apparatus 10 is affixed to a typical step ladder 12. The rung curl 37 and rung curl 37 semicircular lever clamp 38 is around the top rung 14. The semicircular clamp 38 of the a-frame 60 is clamped around the next lower rung 14. The case 30 is thereby extended substantially perpendicularly outward from the ladder 12 length.

Figure 2:
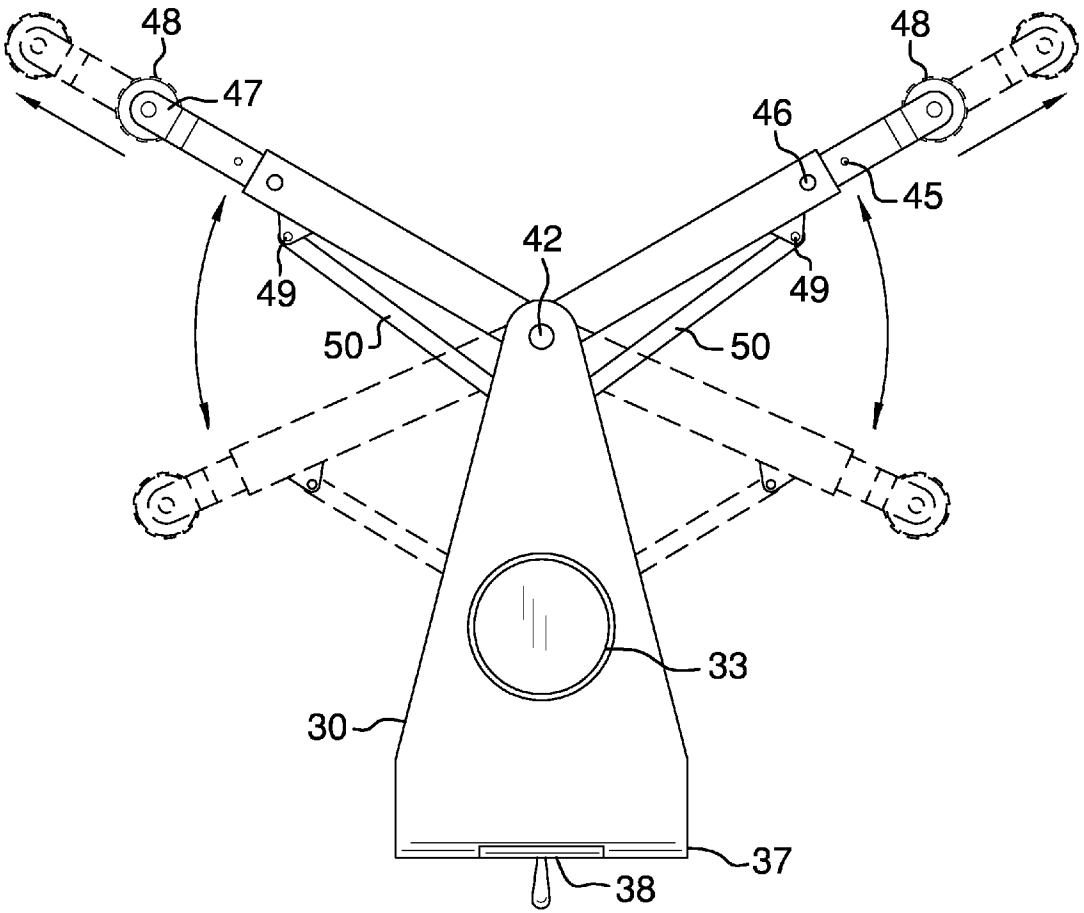
FIG. 2 is a top plan view.

Referring to FIG. 2, for example, crank 75 enabled movement of the rack 54 moves the pushrods 50 horizontally forwardly and backwardly within the slots 36, thereby moving the sleeves 40 forwardly and backwardly. The rollers 48 are thereby moved to best contact a given surface, such as within or on the outsides of a structure corner, for example.

With respect to the above description then, it is to be realized that the optimum dimensional relationships for the parts of the ladder stabilizer apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the ladder stabilizer apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the ladder stabilizer apparatus may be used.

Therefore, the foregoing is considered as illustrative only of the principles of the ladder stabilizer apparatus. Further, since numerous modifications and changes will readily occur to those skilled in the art, it is not desired to limit the ladder stabilizer apparatus to the exact construction and operation shown and described, and accordingly, all suitable modifications and equivalents may be resorted to, falling within the scope of the ladder stabilizer apparatus.

What is claimed is:

1. A ladder stabilizer apparatus comprising, in combination:

a case having a first end spaced apart from a second end;

means for attaching the case to a pair of existing rungs on an existing ladder;

a horizontal opening disposed in the first end;

a vertical pivot disposed within the horizontal opening;

a pair of identical sleeves pivotally affixed oppositely and horizontally to the vertical pivot;

a surface contact device disposed outwardly on each sleeve;

a pair of identical slots disposed oppositely and laterally within the case, the slots proximal to the horizontal opening;

a rod arm disposed horizontally within the case between the slots;

a pair of identical pushrods pivotally and oppositely affixed to the rod arm, each pushrod extended outwardly through one of each of the slots, each pushrod affixed to one of each of the sleeves via a pushrod pivot;

a housing disposed within the case;

an upper cable gear rotateably affixed in a horizontal plane within the housing;

a rack disposed within the housing and extended outwardly therefrom via a pair of spaced apart bushings, the rack in communication with the upper cable gear, the rack affixed perpendicularly to the rod arm;

an exterior crank selectively turning the upper cable gear;

whereby the sleeves are moved forwardly and rearwardly within the horizontal openings.

2. The apparatus according to claim 1 wherein the case further comprises a v-shape having a narrowed first end spaced apart from a widened second end.

3. The apparatus according to claim 1 wherein the surface contact devices comprise a respective u-frame outwardly disposed on each sleeve;

a roller disposed vertically and rotateably within each u-frame.

4. The apparatus according to claim 2 wherein the surface contact devices comprise a respective u-frame outwardly disposed on each sleeve;

a roller disposed vertically and rotateably within each u-frame.

5. The apparatus according to claim 1 wherein the housing disposed within the case is further sealed.

6. The apparatus according to claim 2 wherein the housing disposed within the case is further sealed.

7. The apparatus according to claim 3 wherein the housing disposed within the case is further sealed.

8. The apparatus according to claim 4 wherein the housing disposed within the case is further sealed.

9. The apparatus according to claim 1 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

10. The apparatus according to claim 2 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

11. The apparatus according to claim 3 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

12. The apparatus according to claim 4 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

13. The apparatus according to claim 5 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

14. The apparatus according to claim 6 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

15. The apparatus according to claim 7 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

16. The apparatus according to claim 8 wherein means for attaching the case to a pair of existing rungs on an existing ladder further comprises a downwardly curled rung curl disposed on the case second end a first semicircular lever clamp disposed centrally within the rung curl, the clamp and rung curl selectively disposed around a rung of an existing ladder;

a rod extended downwardly from the case;

a second semicircular lever clamp affixed downwardly to the rod, the rod selectively disposed around a rung of the existing ladder below the rung of the first semicircular lever clamp of the rung curl.

17. A ladder stabilizer apparatus comprising, in combination:

a v-shaped case having a narrowed first end spaced apart from a widened second end;

a horizontal opening disposed in the first end;

a vertical pivot disposed within the horizontal opening;

a pair of identical sleeves pivotally affixed oppositely and horizontally to the vertical pivot;

an identical telescopic arm slideably laterally disposed within each sleeve;

a plurality of spaced apart orifices disposed vertically within each arm;

a lock pin selectively disposed through one of each of the sleeves and through one of each of the orifices of each telescopic arm, whereby the arms are independently and selectively telescoped;

a u-frame outwardly disposed on each telescopic arm;

a roller disposed vertically and rotateably within each u-frame;

a pair of identical slots disposed oppositely and laterally within the case, the slots proximal to the horizontal opening;

a rod arm disposed horizontally within the case between the slots;

a pair of identical pushrods pivotally and oppositely affixed to the rod arm, each pushrod extended outwardly through one of each of the slots, each pushrod affixed to one of each of the sleeves via a pushrod pivot;

a downwardly curled rung curl disposed on the case second end;

a first semicircular lever clamp disposed centrally within the rung curl, the clamp and rung curl selectively disposed around a rung of an existing ladder;

a sealed housing disposed within the case;

an upper cable gear rotateably affixed in a horizontal plane within the housing;

a rack disposed within the housing and extended outwardly therefrom via a pair of spaced apart bushings, the rack in communication with the upper cable gear, the rack affixed perpendicularly to the rod arm;

an a-frame having a proximal end spaced apart from a distal end, the proximal end extended downwardly and pivotally from the v-shaped case;

a cross brace disposed within the a-frame proximal to the distal end;

a second semicircular lever clamp disposed on the a-frame distal end, the lever clamp selectively disposed on a rung of the ladder below the rung curl;

whereby the first and second semicircular clamps of the rung curl and of the a-frame are selectively and removably fastened to the ladder rungs;

a sealed gearbox;

a rail channel spaced apart from a rail channel clamp, the rail channel and rail channel clamp extended from the sealed gearbox;

whereby the gearbox is removably attached to a rail of the ladder;

a pair of spaced apart bushings disposed within the sealed gearbox;

a worm gear rotateably disposed within the bushings and extended from the gearbox;

a crank disposed outwardly from the gearbox and affixed to the worm gear;

a flexible cable extended from the gearbox to the v-shaped case, the cable connecting the lower cable gear to the upper cable gear;

whereby turning the crank moves the rack, thereby pivoting the pushrods relative to the v-shaped case.

18. The apparatus according to claim 17 further comprising a circular holder disposed atop the v-shaped case.

* * * * *